US006916218B2

(12) United States Patent
Lavagna et al.

(10) Patent No.: US 6,916,218 B2
(45) Date of Patent: Jul. 12, 2005

(54) WAVE MOTION ABSORBING OFFLOADING SYSTEM

(75) Inventors: Philippe Lavagna, Monaco (MC); Phillipe Jean, Nice (FR); Jack Pollack, Monaco (MC); Patrick Ducousso, Falicon (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 10/466,046

(22) PCT Filed: Jan. 24, 2002

(86) PCT No.: PCT/EP02/00988

§ 371 (c)(1),
(2), (4) Date: Jul. 11, 2003

(87) PCT Pub. No.: WO02/060750

PCT Pub. Date: Aug. 8, 2002

(65) Prior Publication Data

US 2004/0077234 A1 Apr. 22, 2004

(30) Foreign Application Priority Data

Jan. 24, 2001 (EP) ..... 01200296

(51) Int. Cl.[7] ..... B63B 22/02

(52) U.S. Cl. ..... 441/4

(58) Field of Search ..... 441/3, 4, 5

(56) References Cited

U.S. PATENT DOCUMENTS 3,619,832 A * 11/1971 Westra ..... 441/5
6,109,989 A 8/2000 Etheridge et al.

FOREIGN PATENT DOCUMENTS

| | | |
|---|---|---|
| EP | 0 134 313 | 3/1985 |
| FR | 2 768 993 | 4/1999 |
| FR | 2 808 263 | 11/2001 |
| GB | 2 335 723 | 9/1999 |
| WO | WO 99 62762 | 12/1999 |

* cited by examiner

*Primary Examiner*—Jesus D. Sotelo
(74) *Attorney, Agent, or Firm*—Young & Thompson

(57) ABSTRACT

The invention relates to a hydrocarbon transfer system (1) in which a floating construction (2) such as a FPSO is connected to an offloading buoy (3) via a submerged offloading pipeline (10). The motions of the buoy are de-coupled form the pipeline (10) via connection of the pipeline by a support member (7) and connecting member (8) while the pipeline (10) is extendable in a length direction to compensate for drift phenomena.

17 Claims, 3 Drawing Sheets

WAVE MOTION ABSORBING OFFLOADING SYSTEM

The invention relates to a hydrocarbon transfer system comprising a floating structure and a buoy moored to the seabed, via anchor legs, a fluid transfer duct being connected between the floating structure and the buoy which fluid transfer duct is at its end near the buoy connected to a support member, and a connecting member attaching the support member to the buoy such that displacement of the support member relative to the buoy can occur.

Such a hydrocarbon transfer system is known from FR-A-2 768 993. In this publication, an offshore platform or FPSO is connected to a mooring buoy having catenary anchor legs. The buoy is connected to the floating structure via a tension line comprising a compartmented tube having positive buoyancy. The tube supports hydrocarbon transfer lines and is attached on one end to FPSO whereas the fluid transfer lines are connected to the FPSO by a flexible line section. On the other side, the tension line is connected to the anchor leg of the buoy whereas the fluid transfer line is connected to the buoy via a flexible hose section. An excursion of the FPSO in any direction due to winds or currents, results in an excursion of the buoy of substantially the same amplitude. The distance between the buoy and the FPSO is maintained substantially constant whereas the submerged pipeline does not need to accommodate relative displacements between the buoy and the FPSO.

The known system has as a disadvantage that submerged pipelines of longer length will still be subjected to fatigue problems related to (local) compression and buckling of the fluid transfer line. The known fluid transfer line is connected to the tension member along its whole length, which tension member is part of the total mooring configuration. As a result, the fluid transfer line will be forced to follow the excursions of the buoy and the FPSO whereas the fluid transfer line itself does not contribute to the mooring system. The fluid transfer line has flexible hoses at each end and is not horizontally tensioned. This, in combination with the fact that the FPSO is relatively large and the buoy is small and have different (horizontal) motion behavior in view of their large size difference, leads to horizontal motions and variations in tension on the tension member, which motions will be directly transferred to the steel transfer line and which will create axial stresses as the ends of the steel pipe of the transfer line move in different manner. This results in local fatigue, compression and buckling of the transfer line. The known construction is unsuitable for transfer lines longer than 500 m and using a relatively large shuttle tanker moored to the relatively small buoy. In such case both floating constructions known from FR-A-2 768 993 will have more or less independent motions and excursions which can not be coupled with the vary long tension member, increasing the danger slackening and buckling and compression of the pipeline.

Other systems using large steel pipes as offloading lines for deep water single point mooring terminals, reducing constant wave motion excitations imposed at the Single Point Mooring (SPM)-buoy and at the offloading risers is described in GB-A-2,335,723 and in U.S. Pat. No. 6,109,989. In these known mooring configurations, the fluid transfer lines are directly coupled to the buoy such that vertical and horizontal motions will be transferred directly to the risers, hence creating fatigue problems in the steel pipes resulting in a fatigue life which is too small for the required field (which is typically 25 times 10 or 250 years). Such fatigue problems arise when first order, wave induced high frequency motions of periods of about 10 s occur and cause relatively small drift of a buoy moored in 1000 m water depth of around 3 m. Another fatigue problem for large steel risers is created by second order low frequency motions which could, at a water depth of 1000 m have periods in the range of 1–5 minutes and can cause a relative displacement of an order of magnitude of 400 m between the two floating bodies (so called slow drift motions).

In WO 99/62762 the problem of compression and buckling of the steel fluid transfer line is solved by a compliant submerged pipeline system wherein tensioning weights are added at the end parts of the horizontal pipeline resulting in a horizontal tensioning force on the pipeline ends and thus avoiding the danger buckling and compression.

It is an object of the present invention to provide an offloading system in which the above-discussed problems in relation to pipeline fatigue are solved.

Thereto, the hydrocarbon transfer system of the present invention is characterized in that the support member extends along a minor part of the length of the transfer duct, the fluid transfer duct being extendable in a length direction.

By having a fluid transfer duct, which is extendable in a length direction, and by using a non-restricting support member, such as for instance a collar, a support buoy or Pipe Line End Manifold (PLEM) extending along a smaller length of the transfer duct, the buoy and floating structure can be moored independently. Therefore, the motions of the floating structure are de-coupled from the buoy whereas motions of the buoy are decoupled from the transfer duct. The wave-induced motions of the buoy are absorbed through a deformation of the geometry of the motion decoupling construction of the support member whereas the submerged pipeline is extendable or compliant, e.g. by having a catenary, lazy W, flexible segments configuration, so that it absorbs the relatively large displacements of the two floating structures. The combination of a compliant submerged pipeline connected to the offloading buoy via a "soft yoke" like construction reduces the pipeline fatigue problems to an acceptable level. From a motion point of view, the submerged pipeline is decoupled from the offloading buoy and the compliant submerged pipeline can absorb large motions of both floating bodies, even in the situation when a shuttle tanker of larger bulk is moored to the offloading buoy.

In one embodiment, the connecting member comprises a catenary cable or chain depending with a first end from the buoy and connected with a second end to the support member. By suspending the cable or chain in a loop from the buoy and attaching the support member, a controlled excursion of the support member is possible. By connecting one or more weight elements along the looped chain or cable, a restoring force acts on the support member keeping a stable position below water level and counter-acting drift of the transfer duct end part.

In another embodiment, a cable or chain part may form the connecting member, connected to one of the anchor legs of the buoy for de-coupling high frequency buoy motions from the end part of the transfer line.

In a further embodiment, the connecting member comprises a first pipe segment hingingly connected to the support member, a second pipe segment with a first end connected to the first segment and with a second end connected to the buoy, each end having a hinging connection, a weight being connected near a point of interconnection of the first and second pipe segments. In this embodiment, no separate connecting member is used whereas the end segments of the transfer duct provide a flexible motion decoupling attachment to the buoy.

The transfer duct may be steel piping having a lazy W-shape, catenary-shape or having one or more pivoting points or flexible joints within the pipeline.

In a further embodiment, the fluid transfer duct is connected to the buoy and to the floating structure in a substantially similar manner.

Further advantages of the system of the present invention are not being sensitive to small changes in cargo fluid density. The system can accommodate increasing weights when flushing the fluid transfer duct with water. The decoupled mooring at the buoy end automatically regulates the water depth of the end part of the transfer duct and also the water depth of the support member, which may be a Pipe Line End Manifold (PLEM). The costs of the transfer line can be reduced since the wall thickness of the transfer duct will be diminished, as it will be governed mainly by static pressure design considerations. The mass of steel removed will help reducing the buoyancy. Furthermore, the pressure drop across the transfer duct can be decreased as the inner diameter can be enlarged resulting in less power needed for oil offloading. This is especially significant for transfer ducts of lengths of more than 500 m according to the present invention.

The invention will be described in more detail with reference to the accompanying drawings, wherein.

Figure 1:
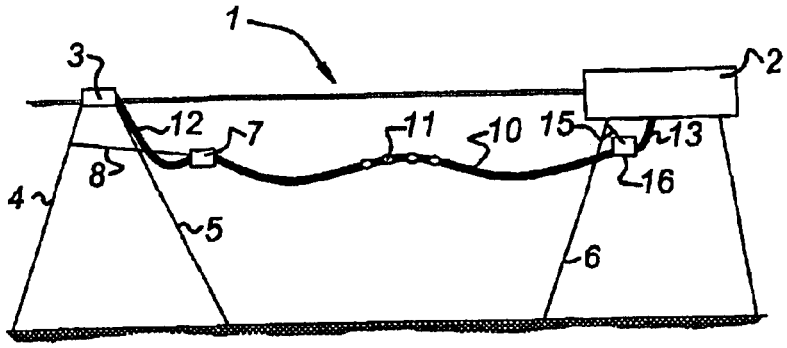
FIG. 1 shows a schematic embodiment of an offloading system of the present invention.
Figure 3:
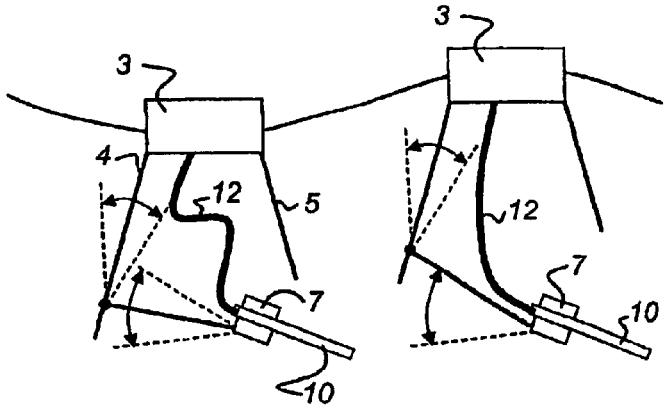
Figure 4:
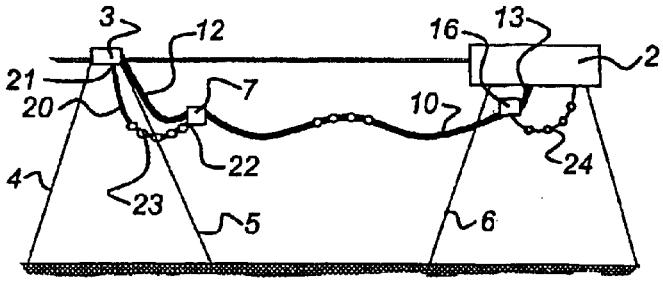
Figure 5:
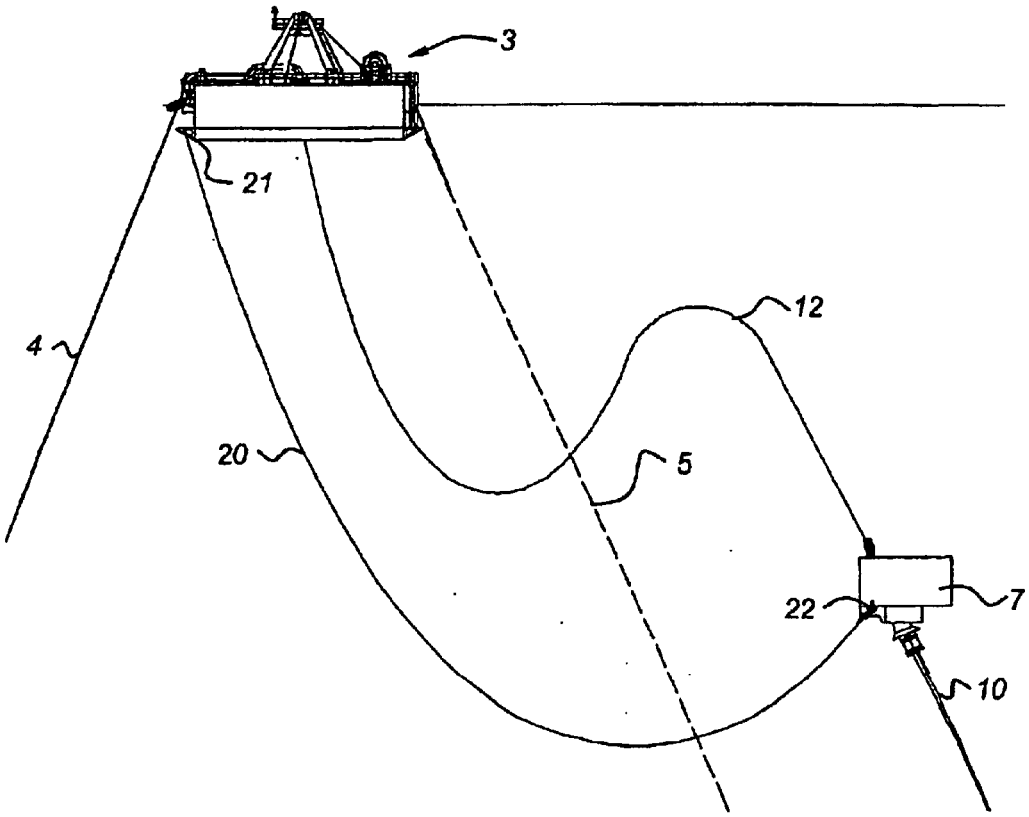
Figure 7:
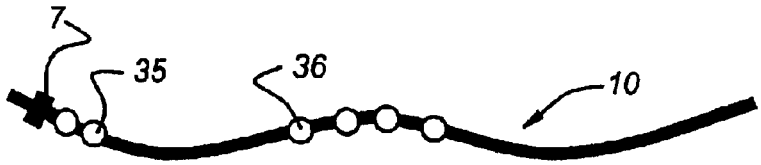
Figure 8:
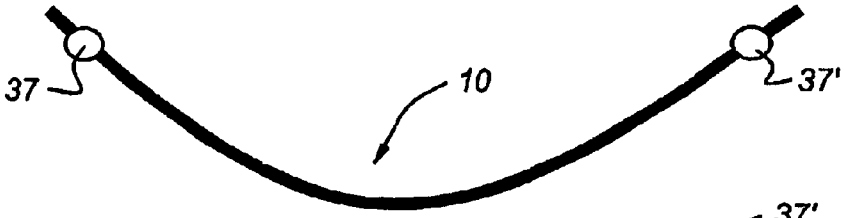
Figure 9:
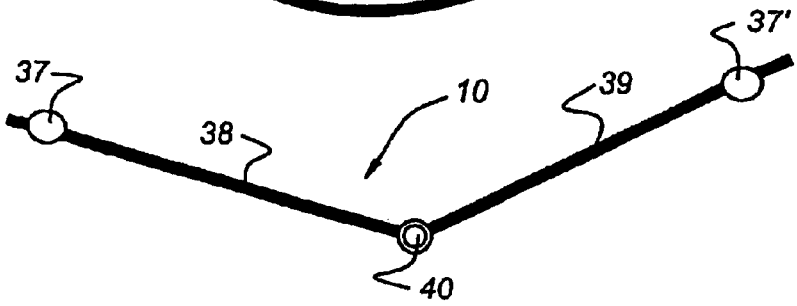
Figure 10:
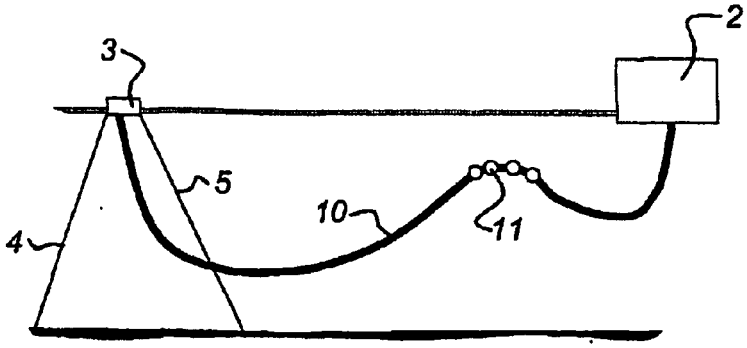

FIG. 3 schematically shows the dynamic behavior of the buoy according to FIG. 1;

FIG. 4 shows an alternative embodiment in which the fluid transfer duct is connected to the offloading buoy via a catenary element;

FIG. 5 shows a detailed side-view of the offloading construction according to FIG. 4;

FIG. 6 shows again an alternative offloading construction according to the present invention;

FIGS. 7–9 show different configurations of the steel transfer pipe of the present invention; and FIG. 10 shows an asymmetric steel transfer duct.

FIG. 1 shows a hydrocarbon transfer system 1 comprising a floating construction 2 such as a FPSO, a production platform, a semi-submersible or other offshore construction which may be anchored to the seabed via anchor legs 6 or which may keep station via a dynamic positioning system. The floating construction 2 is connected to an offloading buoy 3 located at the distance of over 500 m, such as for instance 1–2 km from the floating construction 2. The offloading buoy 3 is connected to the seabed via taut anchoring cables 4, 5 or alternatively via catenary anchor chains. A hydrocarbon transfer duct or offloading pipeline 10 extends below water level at the depth of for instance 500 m between the floating construction 2 and the offloading buoy 3. Shuttle tankers may be moored to the offloading buoy, such that hydrocarbons may be transferred from the floating construction 2 to the shuttle tanker via the buoy 3. At the end of the offloading pipeline 10, which may be formed by a steel pipeline generally of a diameter of 61 cm and a wall thickness of 1.9 cm. A pipe support element, such as a collar or PLEM, is provided which is connected to the anchor leg 4 via a cable 8. A fluid connection in the form of a flexible jumper hose 12 extends between the buoy 3 and the end part of the offloading pipeline 10 at the collar 7. At the side of the floating construction 2, the pipeline 10 may be connected in a similar manner via a support element 16 and cable 15 connected to anchor leg 6. Again, a jumper hose 13 connects the end part of the pipeline 20 to the floating construction 2.

Figure 2:
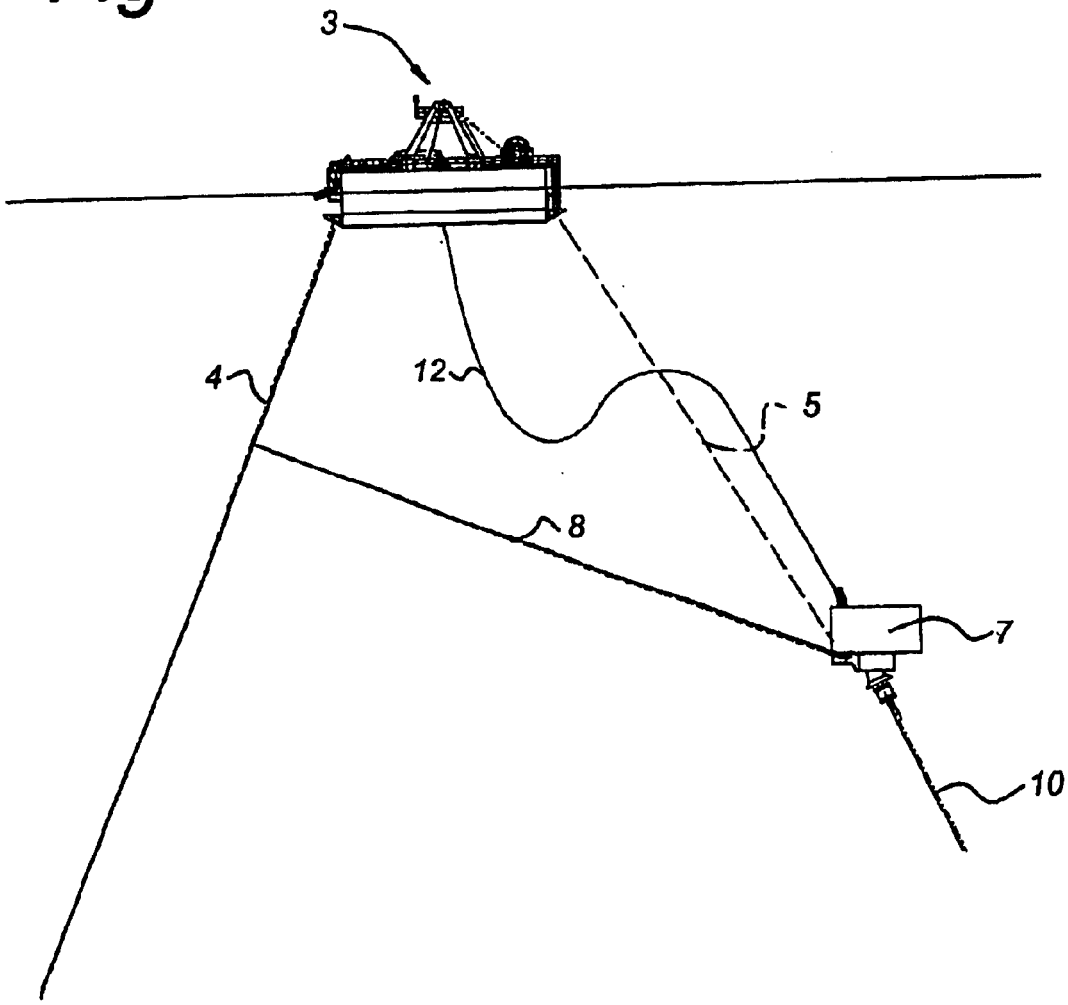
FIG. 2 shows a detail of the offloading buoy according to FIG. 1.

FIG. 2 shows a detail of the offloading buoy 3 showing the support member 7 in detail. The support member 7 may be a buoy having buoyancy or a Pipe Line End Manifold (PLEM) at which the steel offloading pipeline 10 and the flexible jumper hose 12 are interconnected. At the offloading buoy 3, a turntable and a pipe swivel are present for allowing weathervaning of the shuttle tanker connected to the buoy 3 and rotation of the fluid connection of the shuttle tanker and the non-rotating jumper hose 12. For clarity reasons the upper part of the mooring leg 5 has been indicated in a dashed manner. At the part near the buoy or PLEM 7, the offloading pipeline 10 may run parallel to the mooring leg 5.

FIG. 3 schematically shows possible wave-induced motions of the buoy 3, while the support element 7 and the end part of offloading pipeline 10 are maintained at a substantially constant position, the flexible jumper hose 12 taking up variations in distance between the buoy 3 and the end part of offloading pipeline 10.

FIG. 4 shows an alternative embodiment wherein like-elements have been indicated with corresponding reference numerals. The support element 7 is in this case connected to a catenary chain part 20 which is with its first end 21 connected directly to the buoy 3 and with its second end part 22 connected to the support element 7. Weight elements such as clump weights 23 are distributed along a part of the length of the catenary chain or cable 20. The length of the chain or cable 20 may be for instance 175 m with a mass in air of 750 kg/per m. At the side of the floating construction a similar catenary chain or cable 24 as is used at the side of the offloading buoy 3 is employed. It is also possible, however, to use at the side of the floating construction a collar, PLEM or buoy 7 and cable 8 for connecting the offloading pipeline 10 in a manner shown in FIG. 1.

A detail of the offloading construction of FIG. 4 is shown in FIG. 5, showing the pronounced catenary shape of the chain 20 with clump weights distributed in a pronounced catenary shape. The sub sea buoyant PLEM 7 carries the vertical loads of the steel offloading pipeline 10 and a part of the catenary heavy chain. The PLEM 7 is fitted with foam, riser receptacles, a pigging loop and chain stoppers for the catenary chains.

The connection of the jumper hose 12 and the pipeline 10 is made on the sub sea PLEM 7 and can be done while the PLEM 7 is at the surface before installation of the heavy catenary chains.

Typically, three chains 20 can be employed of a length of about 175 m and in mass in air of about 750 kg/per m. Two jumper hoses 12 may be employed having a mass in water of 138 kg/per m (oil filled) and of a length of 195 m. The sub sea buoyant PLEM 7 may have a mass in water of—445 tons and a diameter of 12 m at a height of 5 m. The wave motions of the buoy 3 are absorbed through a deformation of the geometry of the catenary shape of chain 20. Furthermore, the slow drift excursions are transmitted to the steel pipeline 10 without mayor deformation of the catenary shape of chain 20 because the pipeline horizontal loads vary little with horizontal excursions. Therefore, the wave motions are also absorbed when a shuttle tanker is connected to the buoy 3. In order to be an effective motion absorber, the catenary shape of the chain 20 should be pronounced i.e. there must be a certain amount of chain below the sub sea buoyant PLEM 7. This is only possible if the PLEM has enough buoyancy to lift the chain with clumps and therefore create a point at which the tangent to the chain is horizontal.

Figure 6:
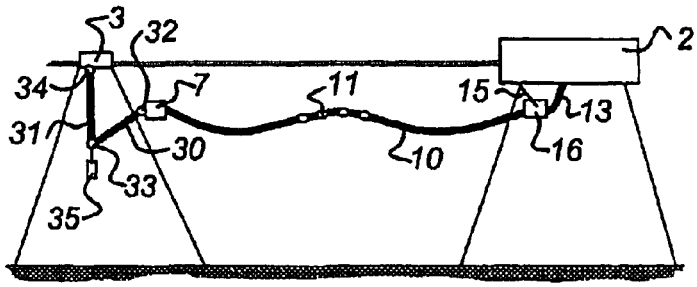

In the embodiment shown in FIG. 6, the support member 7 and the pipeline 10 is in a first hinge point 32 connected to pipe section 30 which in a second hinge point 33 is connected to a second pipe section 31. Pipe section 31 is connected to the buoy 3 in a third hinge point 34. A tensioning weight 35 provides a restoring force upon excursion of the support member 7 by being raised from its equilibrium position. The steel pipeline 10 has an undulating or curved shaped as it is provided with buoyancy elements 11 along at least a part of its length. Thereby, a length variations can be taken up by the steel pipeline 10 such that variations in the distance between floating construction 2 and offloading buoy 3 by slow drift motions can be taken up whereas high frequency motions of the offloading buoy 3 are de-coupled from the steel riser pipe 10 via the soft yoke mooring construction of support member 7 and either cable 8, catenary chain 20 or pipe sections 30, 31.

FIG. 7 shows a Lazy W-shape of the offloading pipeline 10 with buoyancy cans 35, 36, distributed along its length.

According to FIG. 8, the steel offloading pipeline 10 having a catenary shape, at its end part connected to buoyancy elements 37, 37'.

According to FIG. 9, the steel pipeline 10 may be comprised of pipeline segments 38, 39, connected in a pivoting or flexible joint 40 near its midpoint.

FIG. 10 shows a steel offloading pipeline 10 having buoyancy elements, the offloading pipeline having an asymmetric undulating shape in order to decouple the motions of the buoy 3 and the floating structure 2. In this case, the flowline may be directly coupled to the buoy 3.

What is claimed is:

1. Hydrocarbon transfer system (1) comprising a floating structure (2) and a buoy (3) moored to the seabed, via anchor legs (4, 5), a fluid transfer duct (10) being connected between the floating structure and the buoy which fluid transfer duct is extendable in its length direction and is at its end near the buoy connected to a support member (7) that extends along a minor part of the length of the transfer duct (10), a connecting member (8, 20, 30, 31) attaching the support member to the buoy such that displacement of the support member relative to the buoy can occur, characterised in that, the support element (7) comprises a buoyancy member, having such buoyancy that the connecting member (8, 20, 30, 31) extends non-parallel to the trajectory between the support member (7) and the buoy (3), bridging a varying distance between the buoy and the support member upon upward heave movements of the buoy.

2. Hydrocarbon transfer system (1) according to claim 1, the connecting member (20) comprising a cable or chain depending with a first end (21) from the buoy (3), and connected with a second end (22) to the support member (7).

3. Hydrocarbon transfer system (1) according to claim 2, one or more weight elements (23) being placed on the connecting member (20).

4. Hydrocarbon transfer system (1) according to claim 1, the connecting member (8) being connected to one of the anchor legs (4).

5. Hydrocarbon transfer system (1) according to claim 4, the connecting member comprising a first pipe segment (30) hingingly connected to the support structure (7), a second pipe segment (31) with a first end connected to the first segment and with a second end connected to the buoy (3), each end having a hinging connection (32, 33, 34), a weight being connected near a point of interconnection of the first and second pipe segments.

6. Hydrocarbon transfer system (1) according to claim 1, the fluid transfer duct being comprised of metal.

7. Hydrocarbon transfer system (1) according to claim 6, the transfer duct (10) following a curved trajectory between the floating structure and the buoy.

8. Hydrocarbon transfer system (1) according to claim 7, the transfer duct (10) being provided with buoyancy elements (11) along at least a part of its length.

9. Hydrocarbon transfer system (1) according to claim 6, the transfer duct (10) being provided with buoyancy elements (11) along at least a part of its length.

10. Hydrocarbon transfer system (1) according to claim 1, the transfer duct (10) being provided at least one flexible joint (40) along its length.

11. Hydrocarbon transfer system (1) according to claim 1, the fluid transfer duct section (12) extending between the support member and the buoy being a flexible transfer duct.

12. Hydrocarbon transfer system (1) according to claim 1, the support member (7) comprising a collar around the fluid transfer duct.

13. Hydrocarbon transfer system (1) according to claim 1, a support member (7, 6) being provided at each end of the fluid transfer duct (10), connecting the fluid transfer duct to the buoy (3) and to the floating structure (2) respectively.

14. Hydrocarbon transfer system (1) according to claim 13, the fluid transfer duct (10) being connected to the floating structure (2) in a similar way as the connection to the buoy (3).

15. Hydrocarbon transfer system (1) according to claim 1, the fluid transfer duct (10) being longer than 500 m.

16. Hydrocarbon transfer system (1) according to claim 1, the fluid transfer duct (10) extending at a depth of at least 500 m.

17. Hydrocarbon transfer system (1) comprising a floating structure (2) and a buoy (3) moored to the seabed, via anchor legs (4, 5), a fluid transfer duct (10) being connected between the floating structure and the buoy which fluid transfer duct is extendable in its length direction and is at its end near the buoy connected to a support member (7) that extends along a minor part of the length of the transfer duct (10), a connecting member (8, 20, 30, 31) attaching the support member to the buoy such that displacement of the support member relative to the buoy can occur, characterised in that, the connecting member (8, 20, 30, 31) extends non-parallel to the trajectory between the support member (7) and the buoy (3), bridging a varying distance between the buoy and the support member upon upward heave movements of the buoy, wherein the connecting member (8) is connected to one of the anchor legs (4).

* * * * *